US007905240B2

(12) United States Patent
Morselli

(10) Patent No.: US 7,905,240 B2
(45) Date of Patent: Mar. 15, 2011

(54) DEVICE AND METHOD FOR PREVENTING THE DRYING OF FLUID PRODUCTS IN A DISPENSING MACHINE FOR SUCH PRODUCTS

(75) Inventor: Emanuele Morselli, Cavezzo (IT)

(73) Assignee: CPS Color Equipment SPA Con Unico Socio, San Felice Sul Panaro (MO) (IT)

( * ) Notice: Subject to any disclaimer, the term of this patent is extended or adjusted under 35 U.S.C. 154(b) by 606 days.

(21) Appl. No.: 11/910,462

(22) PCT Filed: Apr. 4, 2006

(86) PCT No.: PCT/EP2006/061299

§ 371 (c)(1),
(2), (4) Date: Oct. 2, 2007

(87) PCT Pub. No.: WO2006/106102

PCT Pub. Date: Oct. 12, 2006

(65) Prior Publication Data

US 2008/0264452 A1 Oct. 30, 2008

(30) Foreign Application Priority Data

Apr. 5, 2005 (IT) ..... UD2005A0051

(51) Int. Cl.
*B08B 3/00* (2006.01)

(52) U.S. Cl. ..... 134/105; 134/22.1; 134/22.15; 134/24; 239/8; 239/136

(58) Field of Classification Search ..... None
See application file for complete search history.

(56) References Cited

U.S. PATENT DOCUMENTS

| | | | | |
|---|---|---|---|---|
| 5,842,641 | A | 12/1998 | Mazzalveri et al. | |
| 2003/0097100 | A1 * | 5/2003 | Watson | 604/320 |
| 2004/0056111 | A1 * | 3/2004 | Airaksinen et al. | 239/112 |

FOREIGN PATENT DOCUMENTS

| | | | |
|---|---|---|---|
| EP | 1510260 | A1 | 3/2005 |
| IT | UD2004A000094 | | 5/2004 |
| WO | WO 0212374 | A1 * | 2/2002 |
| WO | 03/082728 | A1 | 10/2003 |
| WO | 2005/107956 | A1 | 11/2005 |

* cited by examiner

*Primary Examiner* — Michael Kornakov
*Assistant Examiner* — Eric Golightly
(74) *Attorney, Agent, or Firm* — Panitch Schwarze Belisario & Nadel LLP

(57) ABSTRACT

A device and a method for preventing the drying of fluid products in a delivery head of a machine for dispensing fluid products, wherein the delivery head is provided with a plurality of delivery nozzles. The device comprises first elements to generate a conditioning flow, second elements to convey the conditioning flow towards a space underneath the delivery nozzles and create in said space an atmosphere different from that of the environment in which the dispensing machine is to be found during use. The delivery nozzles are divided into at least two groups and the space is divided into at least two distinct conditioning zones, disposed in correspondence with the groups of delivery nozzles. Different atmospheres are created in the conditioning zones, according to the type of fluid product delivered by the corresponding group of delivery nozzles.

8 Claims, 2 Drawing Sheets

DEVICE AND METHOD FOR PREVENTING THE DRYING OF FLUID PRODUCTS IN A DISPENSING MACHINE FOR SUCH PRODUCTS

CROSS-REFERENCE TO RELATED APPLICATION

This application is a Section 371 of International Application No. PCT/EP2006/061299, filed Apr. 4, 2006, which was published in the English language on Oct. 12, 2006, under International Publication No. 2006/106102, the disclosure of which is incorporated herein by reference.

FIELD OF THE INVENTION

The present invention concerns a device and a method for preventing the drying of fluid products, such as for example coloring liquids, bases for paints, varnishes, enamels, inks and suchlike, in a dispensing machine for such products. The device is able to be advantageously applied in correspondence with the nozzles of a delivery head of the dispensing machine, and allows to keep specific dyes of different nature, flowing into the same delivery head, at controlled temperature and humidity.

BACKGROUND OF THE INVENTION

Known dispensing or distributing machines for fluid products, such as for example dyes of different shade or color, able to be dosed and/or added to a basic substance so as to form a paint of a determinate color, comprise a plurality of delivery nozzles, of variable number, from some units to some tens, which are grouped together in a delivery head. Each delivery nozzle is connected to a corresponding tank containing a determinate dye and is controlled by an electro-pump which cause the selective delivery of the fluid product in a quantity appropriately chosen, for example with the aid of an electronic processor.

Normally, in the use of such dispensing machines, it is necessary to deliver only a few fluid products at a time, with the consequence that the fluid products, which are not delivered frequently, remain stationary in correspondence with the inactive nozzles and tend to dry out, creating problems at the moment when they need to be delivered.

For example, a device is known, described in the Italian patent application for industrial invention UD2004A000094, filed on Nov. 5, 2004 in the name of the present Applicant. This known device is able to be associated with the delivery head, to keep the terminal parts of the delivery nozzles at a controlled temperature and level of humidity, so as to prevent the drying of the fluid products which are not delivered frequently, limiting the errors in measurement of the quantities delivered and the possible introduction of coagulated particles, which cannot be mixed, into the collection container of the finished product.

From the European patent application EP-A-1.510.260, published on Feb. 3, 2005, a method is also known, for conducting a humidification fluid to the nozzles by means of the micro-capillarity of a fabric (felt).

Producers of paints and varnishes increasingly feel the need to have a delivery head with a high number of nozzles, for example 24 or 32, divided into two or more groups, so as to deliver different types of dyes, such as for example universal dyes, industrial dyes with organic solvents, or decorative dyes, such as water dyes without VOCs (Volatile Organic Components).

In this case, known devices are not able to guarantee optimum humidification for the different groups of delivery nozzles, since the products delivered by each group have different characteristics and they must be humidified and preserved with different parameters and/or by means of different conditioning fluids, for example steam for water dyes and universal dyes and organic solvents for solvent dyes.

This disadvantage can also cause part of the products delivered to dry out, thus making some of the problems previously solved re-surface, such as the difficulty in measuring the delivery and the poor quality of the finished product.

One purpose of the present invention is to achieve a device, and to perfect a method, which prevent the drying of fluid products, also when the same delivery head is provided with different groups of nozzles, able to deliver fluid products with different characteristics.

Another purpose of the present invention is to achieve a device which is simple and economic to make and to use.

The Applicant has devised, tested and perfected the present invention, which brings a significant technical contribution to the state of the art, in order to obtain these and other purposes.

SUMMARY OF THE INVENTION

The present invention is set forth and characterized in the main claims, while the dependent claims describe other characteristics of the invention or variants to the main inventive idea.

In accordance with the above purposes, a device for preventing the drying of fluid products according to the present invention is able to be applied in a delivery head of a dispensing machine for fluid products, in which the delivery head is provided with a plurality of delivery nozzles. To be more exact, the device comprises first means able to generate at least a conditioning flow, second means able to convey the conditioning flow towards a space underneath the delivery nozzles and create therein at least an atmosphere different from that of the environment where the dispensing machine is to be found when in use.

According to a characteristic feature of the present invention, the space underneath the delivery nozzles is divided into at least two distinct conditioning zones, which are disposed in correspondence with an equal number of groups of delivery nozzles, and in which different atmospheres are able to be created, according to the type of fluid product delivered by the corresponding group of delivery nozzles.

With the device according to the present invention, for each specific fluid product able to be delivered by the delivery head it is thus possible to create a specific conditioning atmosphere.

In this way, each fluid product able to be delivered is maintained in its optimum conditions of humidification and preservation, guaranteeing optimum quality of the finished product, and allowing to quantify with accuracy the quantity of product delivered for each individual delivery nozzle.

Moreover, the solution according to the present invention is simple and economic to make and therefore, to the operating advantages explained above, we add also a reduction in production costs and times, and also a considerable ease of use.

In a preferential form of embodiment of the present invention, the space underneath the nozzles is at least partly closable by means of covering means, which comprises closing and conditioning elements able to define, in cooperation with determinate conditioning zones, closed chambers with a specific atmosphere according to the type of fluid product delivered by the corresponding group of delivery nozzles.

Advantageously, the device according to the present invention also comprises detection means, disposed in proximity with the conditioning zones and able to detect one or more significant parameters of the relative atmosphere, and regulation means able to regulate one or more characteristics of the conditioning flow, according to the values detected by the detection means, in order to maintain the significant parameters of the determinate atmosphere inside a set of predetermined values.

Said detection means preferably comprises sensors of a known type, able to detect the conditions of relative humidity (RH %) and temperature (° C.) around the respective conditioning zone.

The sensors are connected to a control circuit, for example electronic, able to command said first means, in order to generate a conditioning flow having pre-determinate values of humidity, temperature and/or delivery, comprised between lower and upper limit values.

In this way, it is possible to manage each conditioning zone independently, in a simple and effective manner, at the same time guaranteeing optimum humidification and preservation of the fluid products when they are not delivered and also during delivery, in the case of a steam generator.

Advantageously, each delivery nozzle comprises a terminal part provided with an inner channel of limited length, with a conical terminal shape, converging towards the inside, so as to reduce the losses of load and to improve the dosage of the fluid product in its minimum quantities, facilitating the detachment thereof.

BRIEF DESCRIPTION OF THE DRAWINGS

These and other characteristics of the present invention will become apparent from the following description of a preferential form of embodiment, given as a non-restrictive example with reference to the attached drawings wherein.

DETAILED DESCRIPTION OF A PREFERENTIAL FORM OF EMBODIMENT

Figure 1:
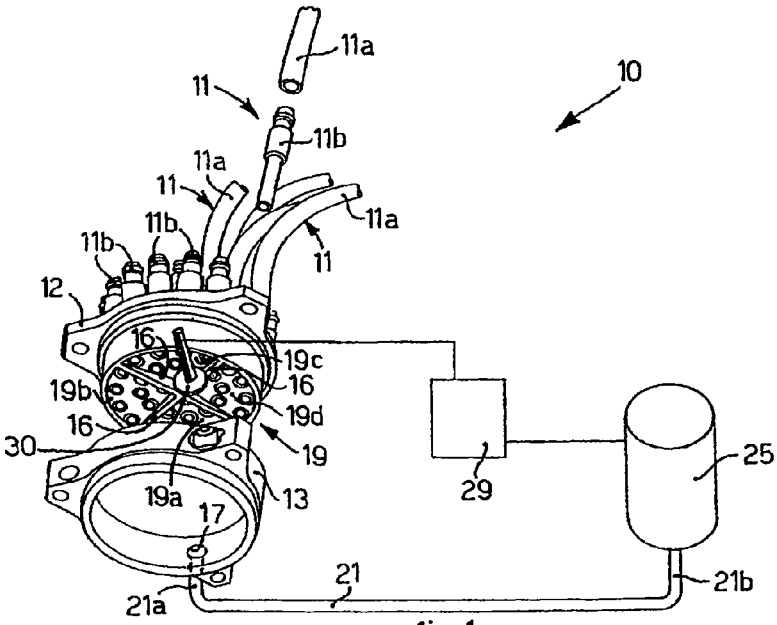
FIG. 1 is a schematic perspective view from below of a device for preventing drying according to the present invention.
Figure 1A:
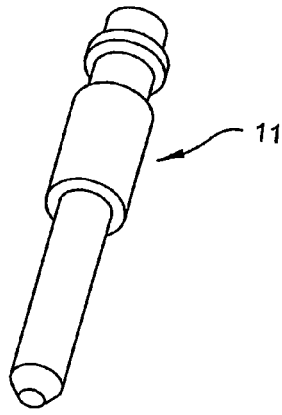
FIG. 1A is a greatly enlarged, perspective view of the nozzle of FIG. 1.
Figure 2:
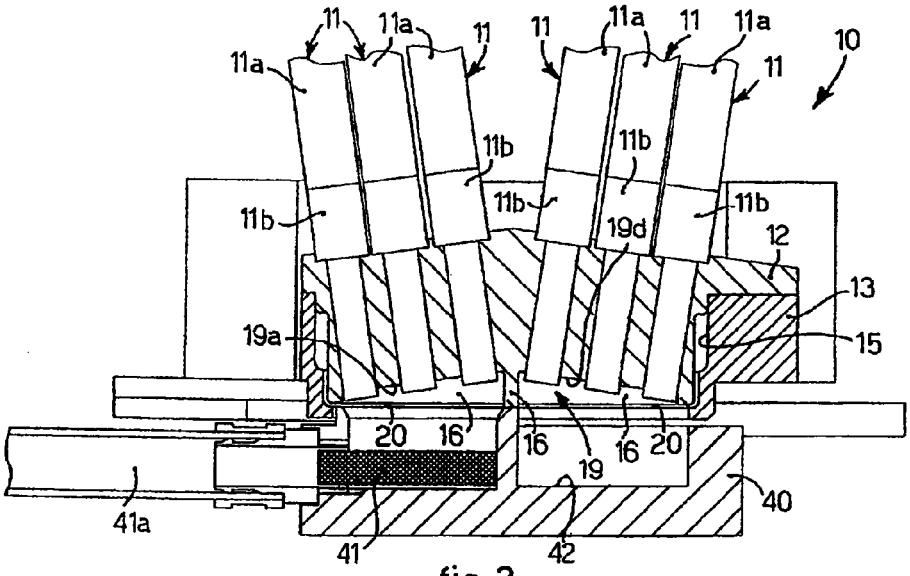
FIG. 2 is a cross section of the device in FIG. 1.
Figure 3:
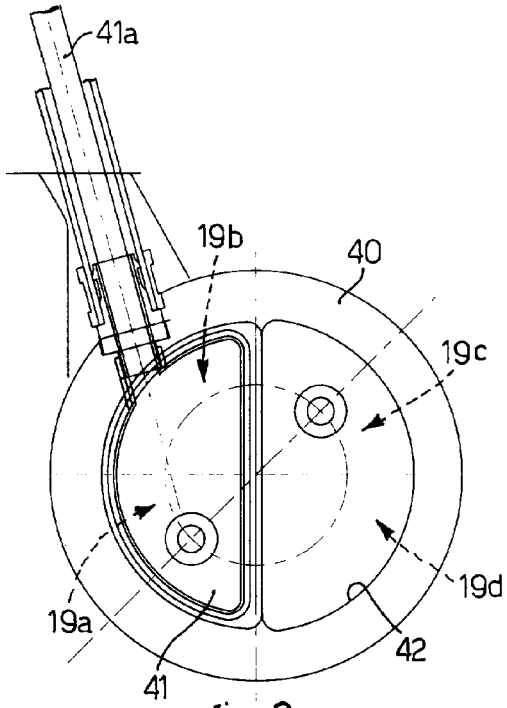
FIG. 3 is a plane view of a covering stopper of the device in FIG. 1, having two symmetrical areas, of which the left one has the inlet of the device to transport fluid by micro-capillarity.

With reference to FIGS. 1, 2 and 3, a device 10 according to the present invention for preventing the drying of fluid products in correspondence with a plurality of delivery nozzles 11 of a delivery head 12 in a dispensing machine for such fluid products comprises an annular element 13 disposed substantially coaxial with the delivery head 12 and shaped so as to define with the outer surface of the delivery head 12 an annular chamber 15 and a space or compartment 19, disposed under the delivery head 12.

The compartment 19 defined under the delivery head 12 is selectively closable by means of a covering stopper 40.

In this case, thirty-two delivery nozzles 11 are provided on the delivery head 12, facing into the compartment 19 and divided into four groups of eight nozzles 11 each. From every group a different fluid product is able to be delivered, such as for example universal dyes, organic-solvent industrial dyes, water dyes without VOCs, and others.

First two groups of delivery nozzles 11 are able to deliver organic-solvent dyes, while second two groups of delivery nozzles 11 are able to deliver water dyes.

Each delivery nozzle 11, in this case, has a dosing pipe 11*a* and a terminal element 11*b*, in order to dose the fluid product to be delivered.

To be more exact, each terminal element 11*b* is substantially tubular in shape and is shaped conical 11*c* at the dosing end so as to reduce the attachment section of the fluid product to be delivered in the immediate proximity of the delivery head 12. In this way, the detachment of the fluid product is encouraged, the accuracy of dosing is increased even with small quantities of fluid product and, thanks to the limited length of the tubular element 11*b*, the losses of load induced are also minimal.

Moreover, the shaping of each terminal element 11*b* of the delivery nozzles 11 also allows to simplify the connection with the dosing pipe 11*b* since, in this case, the connection is effected with a simple binding band, of a known type and not shown here.

The compartment 19 is divided, in this case, into four conditioning zones, respectively 19*a*, 19*b*, 19*c* and 19*d*, substantially equal to each other and from each of which a group of eight delivery nozzles 11 emerges. To be more exact, the nozzles 11 of the groups delivering organic-solvent dyes emerge from the zone 19*a* and from the zone 19*b* whereas the nozzles 11 delivering water dyes or universal dyes emerge from zone 19*c* and zone 19*d*.

The conditioning zones 19*a*, 19*b*, 19*c* and 19*d* are separated from each other by four dividing walls 16, which are made in a piece on the lower surface of the delivery head 12 and are disposed substantially orthogonal with respect to each other.

Between the annular chamber 15 and the compartment 19 an annular passage 20 is provided, advantageously between some tenths of a millimeter and a millimeter wide. The annular passage can advantageously be interrupted radially, in correspondence with the dividing walls 16.

In the annular chamber 15, through a connection hole 17, one end 21*a* of a pipe 21 is inserted, having the other end 21*b* connected to a steam generator device 25, only shown schematically in FIG. 1.

The steam generator 25 is connected to a control unit 29, for example of the electronic type and provided with a microprocessor, which is able to regulate both the quantity and the temperature of the steam delivered.

In this way it is possible to introduce into the annular chamber 15 a desired quantity of steam or a mixture of steam-saturated air which, through the annular passage 20 enters transversely and selectively into the respective conditioning zones 19*a*, 19*b*, 19*c* and 19*d*.

In the annular chamber 15, on the side opposite the connection hole 17, a group of sensors 30 is disposed, of a known type, which is able to detect the percentage of relative humidity (RH %) and temperature (° C.) of the fluid present therein and to transmit corresponding electric signals to a control unit 29.

Moreover, preferably, the group of sensors 30 can in any case send signals to the control unit 29, even during the period of inactivity of the dispensing machine, so as to signal possible anomalies of the covering stopper 40, when the chamber is closed, humidification of every group of delivery nozzles 11, and possibly cause the activation of alarms and/or automatic corrective operations, for example topping up the humidification tank of the steam generator 25.

The control unit 29, according to the data received from the sensor group 30, coordinates and regulates the production and the temperature of the steam, so that inside each conditioning zone 19*c* and 19*d* (universal and water dyes) determinate levels of humidity and temperature are maintained, which guarantee that unused fluid products are maintained without drying, in any operating condition of the machine.

More generally, by acting on the steam generator 25, the control unit 29 can vary the physical and/or chemical characteristics of the flow introduced into the annular chamber 15. To be more exact, both the temperature and quantity of flow introduced can be increased or reduced, so as to vary, for example, the partial pressure in the individual zones 19*c* and 19*d*, in order to prevent dew point from being reached.

The control unit 29 can possibly be integrated into the circuitry of the dispensing machine itself, thus also allowing to easily integrate the device 10 with known systems for humidifying the delivery nozzles 11 during the periods of inactivity of the dispensing machine. In fact, it is sufficient to dispose sensor means, for example of a mechanical, optical, magnetic type or suchlike, able to detect the inactivity of the dispensing machine and/or the presence or absence in correspondence with the delivery head 12 of the covering device 40 of the machine.

The covering stopper 40, as we said, is selectively able to be associated with the lower part of the delivery head 12 and is able to create a closed chamber with humid atmosphere obtained by micro-capillarity and with organic solvents in order to condition in correspondence with the zones 19*a* and 19*b* where the delivery nozzles 11 for organic-solvent dyes are provided, and an open chamber in correspondence with the conditioning zones 19*c* and 19*d* where the delivery nozzles 11 for water dyes are provided.

In fact, as shown in FIGS. 2 and 3, the covering stopper 40 comprises, in correspondence with the two conditioning zones 19*a* and 19*b*, a felt 41, soaked in organic solvents and kept damp by means of micro-filtration which, when the covering stopper 40 is disposed below the delivery head 12, determines the air-tight closure of said two conditioning zones 19*a* and 19*b*. The felt 41 defines inside the two conditioning zones 19*a* and 19*b* a desired atmosphere saturated with organic solvents.

The felt 41 is provided with a tail 41*a*, which is partly immersed, in known manner, in a container containing a conditioning fluid as described in the above-mentioned European patent application EP-A-1.510.260.

The control unit 29, under any operating condition of the dispensing machine, is able to manage the different components of the device 10, so as to obtain and guarantee the best conditions for preserving the dyes in the zones 19*c* and 19*d*.

The covering stopper 40 of the delivery head 12, with the dispensing machine in inactive condition, is closed, and maintains the desired atmosphere saturated with organic solvents in the conditioning zones 19*a* and 19*b* through the micro-filtration system.

On the contrary, the covering stopper 40 comprises in correspondence with the conditioning zones 19*c* and 19*d* a through aperture 42, which allows to maintain optimum conditions of preserving the conditioning parameters also during the dosing steps.

The device 10 as described heretofore functions as follows.

Through the pipe 21, a flow of air mixed with steam is introduced into the annular chamber 15.

The optimum levels, comprised between maximum and minimum values, of the significant parameters of the flow, that is, those relating to the relative humidity and temperature, are pre-determined and obtained under the control of the control unit 29.

The flow of air mixed with steam is introduced into the conditioning zones 19*c* and 19*d* through the annular passage 20, in a substantially radial and angled manner, advantageously orthogonal to the direction of delivery of the fluid products through the delivery nozzles 11. In this way, in the various conditioning zones 19*c* and 19*d*, determinate atmospheres are created having different rates of humidity (RH %) and temperature (° C.).

The sensor group 30 continuously detects the actual values of humidity and temperature inside the conditioning zones 19*c* and 19*d*, and transmits, in feedback, the values detected to the control unit 29, which possibly modifies the conditions under which the flows are generated, so that the values of the significant parameters are always comprised within the predetermined limit values.

The parameters that can be controlled also comprise, for example but not only, physical and chemical characteristics of the air and/or steam present in the various conditioning zones 19*c* and 19*d*, like the relative or partial pressure. There are many variables on which the control unit 29 can act in feedback, to modify the environmental conditions. Some particularly significant but non-limiting examples are: temperature, partial pressure, titer, volume and quantity of the solvent introduced, relative humidity of the mixture of air and steam introduced, introduction rate and, in general, one or more physical and/or chemical characteristics of the solvent, the steam or the mixture of air and steam introduced into the conditioning zone of the relative group of nozzles 11.

To be more exact, the control unit 29 controls whether the air around the conditioning zones 19*c* and 19*d* of every group of delivery nozzles 11 is saturated or near saturation. If so, the control unit 29 corrects in feedback the environmental conditions around the various groups of delivery nozzles 11, for example, by raising the temperature or lowering the relative humidity of the flow in the relative conditioning zones 19*c* and 19*d*.

It is clear that modifications and/or additions of parts or steps may be made to the device 10 and the method as described heretofore, without departing from the scope of the present invention.

Figure 4:
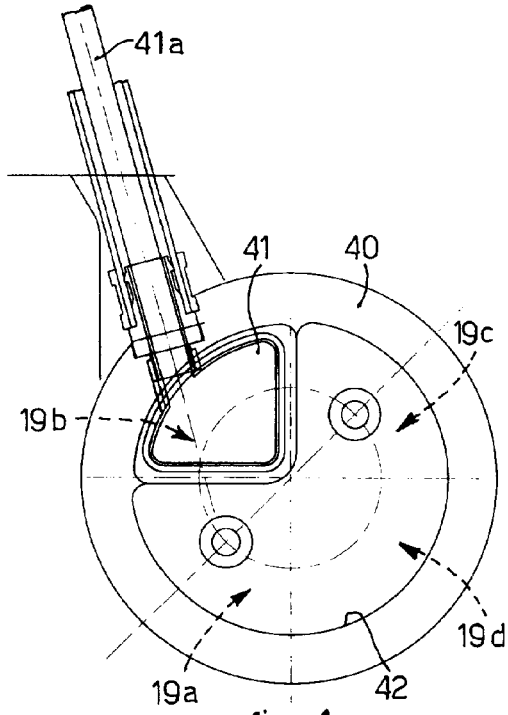
FIG. 4 is a first variant of the covering stopper in FIG. 3, having two areas of different size, of which the upper left one has the inlet of the device to transport fluid by micro-capillarity.

For example, according to the variant shown in FIG. 4, if only one quarter of the delivery nozzles 11 provided on the delivery head 12 are able to deliver an organic solvent dye, the felt 41 of the covering stopper 40 can extend only for a quarter of the total surface, and completely close only one conditioning zone 19*b*.

Figure 5:
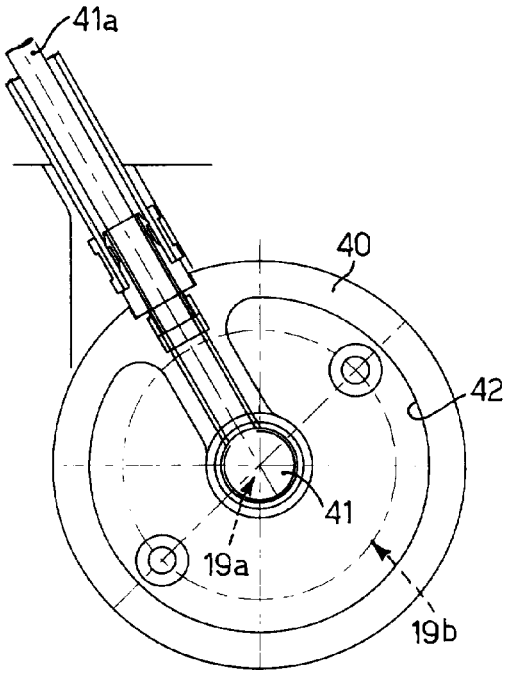
FIG. 5 is a second variant of the covering stopper in FIG. 3, having two concentric areas of which the smaller central one has the inlet of the device to transport fluid by micro-capillarity.
Figure 6:
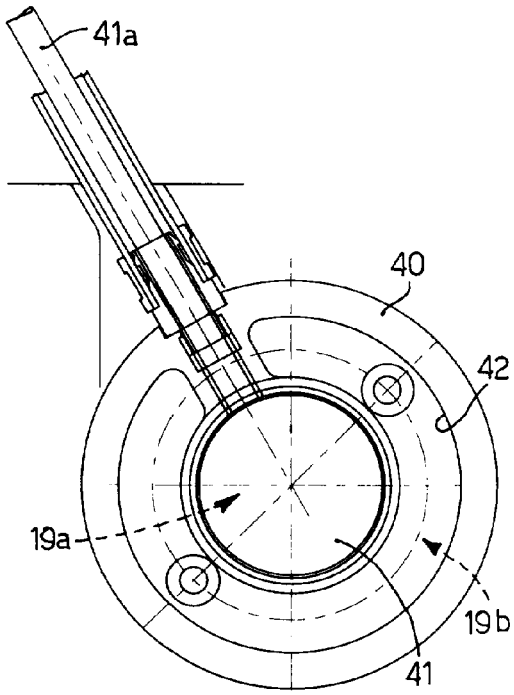
FIG. 6 is a third variant of the covering stopper in FIG. 3, having two concentric areas of which the central one, which is larger in size than that in FIG. 5, has the inlet of the device to transport fluid by micro-capillarity.

In the solutions shown in FIGS. 5 and 6, instead of having a segmented shape as in the previous cases, the felts 41 have a substantially circumferential shape.

In general, it comes within the scope of the present invention to provide that the felts 41 can have a shape and disposition corresponding to the distribution of the groups of delivery nozzles 11 in the delivery head 12.

It is also clear that, although the present invention has been described with reference to a specific example, a person of skill in the art shall certainly be able to achieve many other equivalent forms of device and method, having the characteristics as set forth in the claims and hence all coming within the field of protection defined thereby.

The invention claimed is:

1. A device for preventing the drying of fluid products comprising:

a delivery head of a machine for dispensing said fluid products, wherein said delivery head is provided with a plurality of delivery nozzles, first means able to generate at least a conditioning flow, second means able to convey said conditioning flow towards a space underneath said delivery nozzles and create in said space at least an atmosphere different from that of an environment in which said dispensing machine is to be found during use, wherein said delivery nozzles are divided into at least two groups, and wherein said delivery head includes a dividing wall separating the space into at least two distinct conditioning zones, disposed in respective correspondence with said groups of said delivery nozzles, and in which different atmospheres are created by the first means.

2. A device as in claim 1, further comprising covering means able to selectively close at least partly said space underneath said delivery nozzles.

3. A device as in claim 2, wherein said covering means comprises:

a micro-capillary device, and at least a closing and conditioning element able to define, in cooperation with at least one of the conditioning zones, a corresponding closed chamber with a saturated atmosphere provided by the micro-capillary device.

4. A device as in claim 1, wherein the device further comprises an annular chamber formed by the delivery head and an annular element, and wherein said first means comprises:

at least a generator member generating a flow of air mixed with steam, and wherein said second means comprises at least a pipe associated with said generator member to convey said flow of air mixed with steam towards the annular chamber selectively open towards said conditioning zones.

5. A device as in claim 4, further comprising detection means disposed in proximity with said conditioning zones, and able to detect one or more significant parameters of said atmosphere created, and regulation means able to regulate one or more characteristics of said conditioning flow, according to values detected by said detection means, in order to maintain the significant parameters of each atmosphere inside a set of predetermined values.

6. A device as in claim 5, wherein said detection means comprises one or more sensors disposed in said annular chamber and able to detect the conditions of relative humidity (RH %) and temperature (° C.) in the relative conditioning zone.

7. A device as in claim 1, wherein each of said delivery nozzles comprises:

at least a terminal element having a delivery chamber with a conical end, converging inwardly, so as to promote detachment of said fluid product to the delivery nozzle at an end of a delivery of said fluid product.

8. A device for preventing the drying of fluid products comprising:

a delivery head of a machine for dispensing said fluid products, said delivery head including:

a plurality of delivery nozzles, and a dividing wall extending from a lower surface of the delivery head forming at least a first and a second conditioning zone;

a steam generator generating a first conditioning flow;

a pipe in communication with the steam generator and the delivery head for conveying the first conditioning flow to the first conditioning zone to create an atmosphere different from that of an environment in which the dispensing machine is to be found during use, a micro-capillary device configured to generate a second conditioning flow and deliver the second conditioning flow to the second conditioning zone;

wherein said delivery nozzles are divided into at least two groups corresponding to the at least two distinct conditioning zones, respectively, and wherein different atmospheres are created in the first and the second conditioning zones.

* * * * *